US009446286B2

(12) United States Patent
Wang

(10) Patent No.: US 9,446,286 B2
(45) Date of Patent: Sep. 20, 2016

(54) FOLDABLE AND TRACK-CHANGEABLE TRAINING CHAIR FOR COORDINATED EXERCISES OF UPPER AND LOWER LIMBS

(71) Applicant: WUHU NATURE INTELLIGENT MACHINERY CO., LTD, Wuhu, Anhui (CN)

(72) Inventor: Yong Wang, Anhui (CN)

(73) Assignee: WUHU NATURE INTELLIGENT MACHINERY CO., LTD, Wuhu (CN)

( * ) Notice: Subject to any disclaimer, the term of this patent is extended or adjusted under 35 U.S.C. 154(b) by 0 days.

(21) Appl. No.: 14/979,603

(22) Filed: Dec. 28, 2015

(65) Prior Publication Data

US 2016/0158596 A1 Jun. 9, 2016

Related U.S. Application Data

(63) Continuation-in-part of application No. PCT/CN2014/000331, filed on Mar. 26, 2014.

(30) Foreign Application Priority Data

Jul. 12, 2013 (CN) ..... 2013 1 0291773

(51) Int. Cl.
*A61H 1/02* (2006.01)
*A63B 21/00* (2006.01)
(Continued)

(52) U.S. Cl.
CPC ..... *A63B 23/03591* (2013.01); *A61H 1/0237* (2013.01); *A61H 1/0274* (2013.01); *A63B 21/00178* (2013.01); *A63B 21/015* (2013.01); *A63B 21/018* (2013.01); *A63B 22/001* (2013.01); *A63B 22/0012* (2013.01);
(Continued)

(58) Field of Classification Search
CPC ..... A61H 1/0237–1/0259; A61H 1/0274–1/0281; A63B 23/03575; A63B 23/03591; A63B 21/00178; A63B 21/4029–21/4031; A63B 21/1609; A63B 22/0048; A63B 22/0056; A63B 2022/0053
See application file for complete search history.

(56) References Cited

U.S. PATENT DOCUMENTS 5,611,758 A * 3/1997 Rodgers, Jr. ..... A63B 22/001 482/51
7,452,308 B2 * 11/2008 Robideau ..... A61H 1/02 482/51
2003/0087737 A1 * 5/2003 Studdard ..... A63B 21/02 482/142

FOREIGN PATENT DOCUMENTS

CN 103230331 A 8/2013
CN 203315281 U 12/2013

OTHER PUBLICATIONS

1st Office Action of counterpart Chinese Patent Application No. 201310291773.5 issued on Oct. 10, 2014.
(Continued)

*Primary Examiner* — Oren Ginsberg
*Assistant Examiner* — Jennifer M Deichl

(57) ABSTRACT

The Invention discloses a foldable and track-changeable training chair for coordinated exercises of upper and lower limbs, comprising: a seat, a driving device below the seat and racks on both sides of the seat; an out-stretched driving shaft and an accessory shaft are arranged on each side of the driving device; one end of the crank of the seven-bar mechanism on both sides of the seat is fixed to the driving shaft, the other end is hinged to the head end of the first connecting rod to form a revolute pair. The Invention has a simple structure and wide usage.

4 Claims, 3 Drawing Sheets

(51) Int. Cl.

| | |
|---|---|
| ***A63B 21/015*** | (2006.01) |
| ***A63B 21/018*** | (2006.01) |
| ***A63B 22/00*** | (2006.01) |
| ***A63B 22/06*** | (2006.01) |
| ***A63B 23/035*** | (2006.01) |

(52) U.S. Cl.

CPC ... *A63B22/0664* (2013.01); *A61H 2201/0149* (2013.01); *A61H 2201/1215* (2013.01); *A61H 2201/1269* (2013.01); *A61H 2201/1436* (2013.01); *A61H 2201/164* (2013.01); *A61H 2201/1635* (2013.01); *A61H 2201/1676* (2013.01); *A61H 2203/0425* (2013.01); *A63B 22/0007* (2013.01); *A63B 2022/0682* (2013.01); *A63B 2208/0238* (2013.01); *A63B 2210/50* (2013.01)

(56) References Cited

OTHER PUBLICATIONS

2nd Office Action of counterpart Chinese Patent Application No. 201310291773.5 issued on May 25, 2015.

* cited by examiner

FOLDABLE AND TRACK-CHANGEABLE TRAINING CHAIR FOR COORDINATED EXERCISES OF UPPER AND LOWER LIMBS

CROSS-REFERENCE TO RELATED APPLICATIONS

This present application is a Continuation-in-Part application of PCT application No. PCT/CN2014/000331 filed on Mar. 26, 2014, which claims the benefit of Chinese Patent Application No. 201310291773.5 filed on Jul. 12, 2013, the contents of which are hereby incorporated by reference.

TECHNICAL FIELD

The Invention relates to a foldable and track-changeable training chair for coordinated exercises of upper and lower limbs, which belongs to the field of rehabilitation therapy and exercise and fitness equipment.

DESCRIPTION OF THE RELATED ART

The *Statistical Bulletin of China Aging Development of* 2010 indicates that China has an aged population of 177.65 million who are 60 years old and above, accounting for 13.26% of the total population, an increase of 2.93 percentage points compared with the fifth population census of China in 2000, thus it can be seen that the aging population of China is keep on increasing; with the development of society, the groups engaged in sedentary working increase continuously, thus the population who suffer from occupational diseases of white-collars increases unceasingly as well. The prevention and rehabilitation of senile diseases and the prevention and management of occupational diseases of white-collars have become a serious challenge in today's society. In recent years, the research on training aids for rehabilitation and fitness has reached a lot of achievements, for example, the researches on and the usages of the training aids of end effector pull-type, exoskeleton wearable and all kinds of exercise and fitness have been developed greatly. However, the shortcomings of these training aids lie in that: a specialized caregiver is needed during the whole training; the structure of the training aids is complex; the space for application is large; the form of exercise is single; they lack coordinated exercises of upper and lower limbs; they are unfoldable and track-unchangeable; therefore, these training aids do not possess common applicability and it is hard to meet the requirement of rehabilitation and fitness at home or in work place.

SUMMARY OF THE INVENTION

In order to overcome the defects of the prior art, the Invention is aimed at providing a foldable and track-changeable training chair for coordinated exercises of upper and lower limbs with a simple and compact structure and wide application range, which may meet the requirement of amplitude-adjustable rehabilitation and fitness training for coordinated exercises of upper and lower limbs in small space environment at home or in the office.

The following technical schemes are adopted by the Invention to solve the technical problems:

A foldable and track-changeable training chair for coordinated exercises of upper and lower limbs, comprising:

A seat, a driving device arranged below the said seat and the racks arranged on both sides of the seat; an out-stretched driving shaft and accessory shaft are arranged on each side of the said driving device; two seven-bar mechanisms are distributed symmetrically on both sides of the said seat;

the said seven-bar mechanism comprises: a crank, a first connecting rod, a second connecting rod, a side link, a third connecting rod, a jointed arm and a rack; one end of the said crank is fixed to the said driving shaft and the other end is hinged to the head end of the said first connecting rod to form a revolute pair; the tail end of the first connecting rod is hinged to the head end of the said second connecting rod to form a revolute pair; the tail end of the second connecting rod is hinged to the head end of the said side link to form a revolute pair; the tail end of the side link is fixed to the said accessory shaft; one end of the said third connecting rod is hinged to the said crank or the said first connecting rod or the said second connecting rod to form a revolute pair; the other end of the third connecting rod is hinged to the bottom of the said jointed arm to form a revolute pair; the intermediate section of the said jointed arm is hinged to the rack to form a revolute pair;

a foot support is installed on the said first connecting rod or the said second connecting rod and a handle is installed on the upper end of the said jointed arm.

The said driving shaft is driven to rotate by power mechanism through a main driving chain; the said accessory shaft is driven to rotate by an accessory driving chain.

The hinge joint of one end of the said third connecting rod on the said crank or the said first connecting rod or the said second connecting rod is adjustable; the hinge joint of the said jointed arm on the said rack is adjustable; the position of the said foot support on the first connecting rod or the second connecting rod is adjustable.

The other embodiment of the Invention is:

A foldable and track-changeable training chair for coordinated exercises of upper and lower limbs, comprising:

A seat, a driving device arranged below the said seat and the racks arranged on both sides of the seat; an out-stretched driving shaft is arranged on each side of the said driving device; two seven-bar mechanisms are distributed symmetrically on both sides of the said seat;

the said seven-bar mechanism comprises: a crank, a first connecting rod, a second connecting rod, a side link, a third connecting rod, a jointed arm and a rack; one end of the said crank is fixed to the said driving shaft and the other end is hinged to the head end of the said first connecting rod to form a revolute pair; the tail end of the first connecting rod is hinged to the head end of the said second connecting rod to form a revolute pair; the tail end of the second connecting rod is hinged to the head end of the said side link to form a revolute pair; the tail end of the side link is hinged to the said rack; one end of the said third connecting rod is hinged to the said first connecting rod or the said crank to form a revolute pair; the other end of the third connecting rod is hinged to the bottom of the said jointed arm to form a revolute pair; the intermediate section of the said jointed arm is hinged to the rack to form a revolute pair; setting a linear actuator, one end of the said linear actuator is hinged to the rack to form a revolute pair and the other end is hinged to the intermediate section of the side link to form a revolute pair;

a foot support is installed on the said first connecting rod or the said second connecting rod and a handle is installed on the upper end of the said jointed arm.

Compared with the prior art, the beneficial effects of the Invention lie in that:

1. The Invention is widely applicable and may be used for coordinated exercises of upper and lower limbs and trunk to achieve the purpose of rehabilitation and fitness by exercises.

2. The Invention has multiple exercise models; the handles and the pedals are symmetrically arranged on both sides of the seat to realize synchronous/asynchronous training.

3. The Invention has a compact and flexible structure and may be retracted and stretched freely. It may be folded when not used and only need a small space for storage.

4. The Invention is adjustable. The initial position of the jointed arm, the position of the foot support on the first or second connecting rod and the angle of the side link may be adjusted in combination to realize the exercise trainings with different tracks and different amplitudes. It is not only suitable for different exercises taken by the same trainee in different rehabilitative period and under different training conditions but also applicable to trainees with different height to meet the requirement of rehabilitation and fitness exercise.

5. The motor is controlled by a clutch to drive the crank or the side link. One driving motor may be shared by both crank and side link.

6. If a resistance mechanism is set in the driving chain, an active training may be realized to drive four limbs to exercise; moreover, it may produce resistance so as to be used as a fitness equipment.

7. The hinge joint of the jointed arm on the rack is adjustable; the hinge joint of the third connecting rod on the crank or the first or second connecting rod is also adjustable; the exercise tracks may be changed to adjust the exercise amplitude of hands by adjusting the hinge joint.

Labels in the figures: 1, crank; 2, first connecting rod; 3, second connecting rod; 4, side link; 5, third connecting rod; 6, jointed arm; 7, rack; 8, foot support; 9, handle; 10, accessory shaft; 11, main driving chain; 12, driving shaft; 13, accessory driving chain; 14, seat; 15, driving device; 16, seven-bar mechanism; 17, linear actuator.

The Invention is further explained through the following embodiments in combination with the drawings.

DESCRIPTION OF THE PREFERRED EMBODIMENTS

Figure 1:
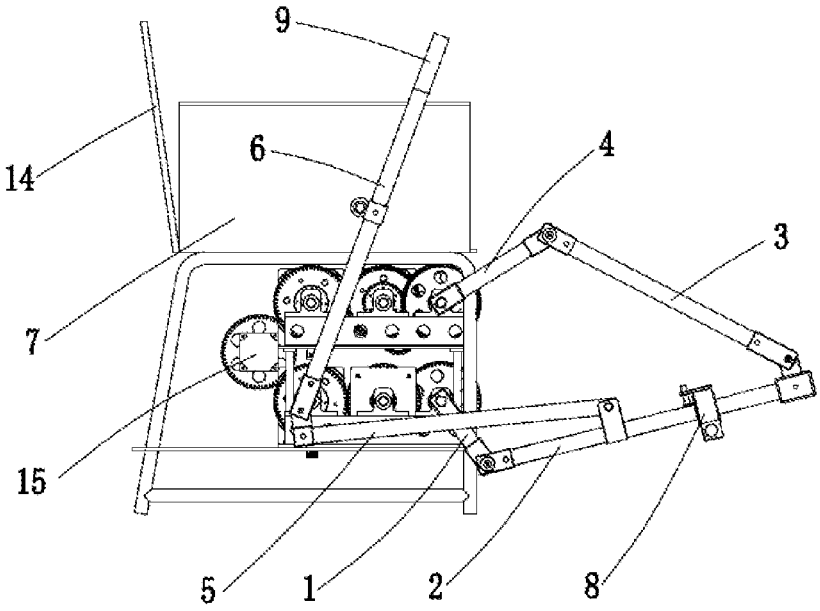
FIG. 1 is the front view schematic diagram of the hinge joint between the third connecting rod and the first connecting rod of the Invention.
Figure 2:
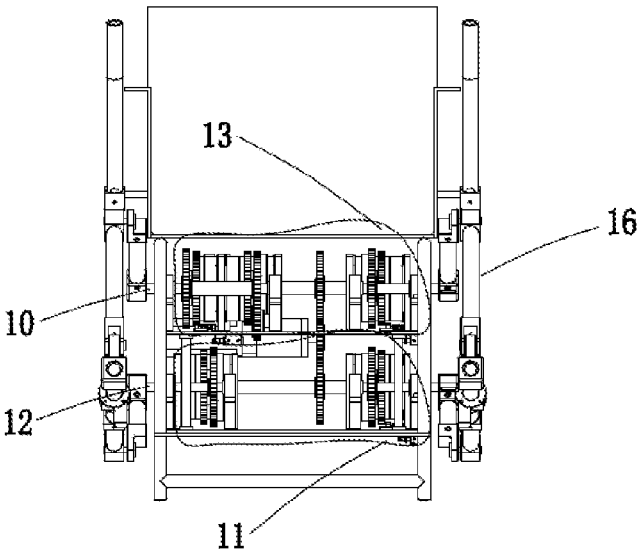
FIG. 2 is the right view schematic diagram of the hinge joint between the third connecting rod and the first connecting rod of the Invention.

Embodiment: in combination with FIGS. 1 and 2, the foldable and track-changeable training chair for coordinated exercises of upper and lower limbs of the Embodiment comprises:

A seat 14, a driving device 15 arranged below the seat and the racks 7 arranged on both sides of the seat; an out-stretched driving shaft 12 and accessory shaft 10 are arranged on each side of the driving device 15; two seven-bar mechanisms 16 are symmetrically distributed on both sides of the seat;

Wherein, the seven-bar mechanism comprises a crank 1, a first connecting rod 2, a second connecting rod 3, a side link 4, a third connecting rod 5, a jointed arm 6 and a rack 7; one end of the crank 1 is fixed to the driving shaft 12 and the driving shaft and the rack 7 form a revolute pair; the other end of the crank is hinged to the head end of the first connecting rod 2 to form a revolute pair; the tail end of the first connecting rod 2 is hinged to the head end of the second connecting rod 3 to form a revolute pair; the tail end of the second connecting rod 3 is hinged to the head end of the side link 4 to form a revolute pair; the tail end of the side link 4 is fixed to the said accessory shaft 10 and the accessory shaft and the rack 7 form a revolute pair; one end of the third connecting rod 5 is hinged to the first connecting rod 2 to form a revolute pair and the other end is hinged to the bottom of the jointed arm 6 to form a revolute pair; the intermediate section of the jointed arm 6 is hinged to the rack 7 to form a revolute pair;

a foot support 8 is installed on the first connecting rod 2 or the second connecting rod 3 and a handle 9 is installed on the upper end of the jointed arm 6.

Figure 4:
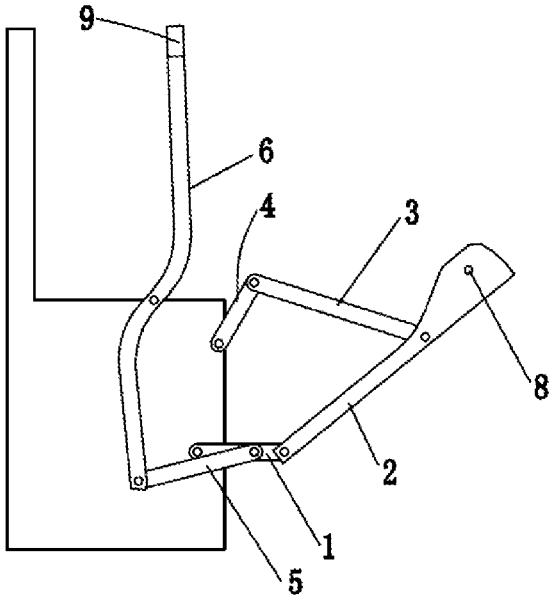
FIG. 4 is the front view of the hinge joint between the third connecting rod and the crank.

In combination with FIG. 4, one end of the third connecting rod 5 is hinged to the crank 1 to form a revolute pair; the other end is hinged to the bottom of the jointed arm 6 to form a revolute pair; the intermediate section of the jointed arm 6 is hinged to the rack 7 to form a revolute pair;

a foot support 8 is installed on the first connecting rod 2 or the second connecting rod 3 and a handle 9 is installed on the upper end of the jointed arm 6.

Figure 5:
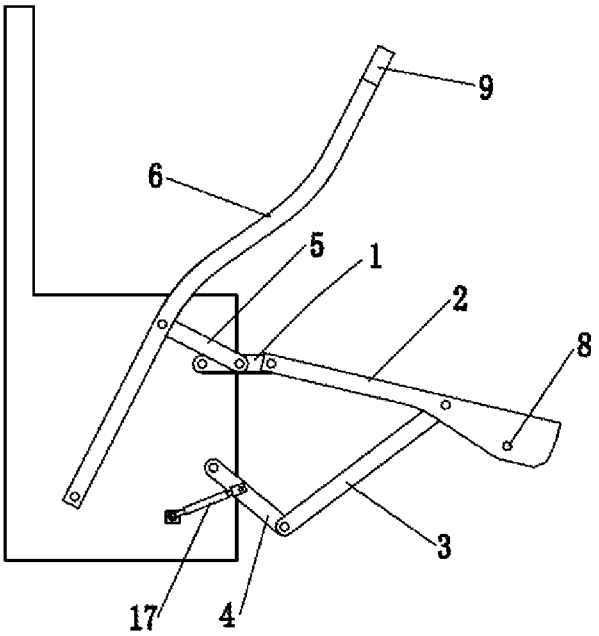
FIG. 5 is the front view of the second scheme of the Invention that the crank is installed on the upper part, adopting a linear actuator to replace an accessory shaft and accessory driving chain.

In the specific settings, the driving shaft 12 is driven to rotate by power mechanism through the main driving chain 11; the accessory shaft 10 is driven to rotate by an accessory driving chain 13. In order to facilitate adjusting the hand and foot exercise tracks, the hinge joint of one end of the third connecting rod 5 on the crank 1 or the first connecting rod 2 or the second connecting rod 3 is adjustable; the hinge joint of the jointed arm 6 on the rack 7 is adjustable; the position of the foot support 8 on the first connecting rod 2 or the second connecting rod 3 is adjustable between the two revolute pairs or on the out-stretched portions of the first connecting rod 2 or the second connecting rod 3. As shown in FIGS. 4 and 5, the adjustment may be realized through the holes and grooves of different positions, or the movement of ballscrew and linear guide, or the rotation of worm wheel and worm screw.

In specific application, the driving device 15 is composed of both the main driving chain 11 and the accessory driving chain 13; the main driving chain 11 and the accessory driving chain 13 are selected through controlling the clutch and driven by a motor. The main driving chain 11 and the accessory driving chain 13 are composed of gears, belt wheels or chain wheels, etc. and equipped with a brake and a self-lock device.

The clutches are installed respectively on the main driving shaft 12 and the accessory shaft 10, then the motor may be controlled by the clutch to drive the crank or the side link. Thus, one driving motor may be shared by both crank and side link.

Figure 3:
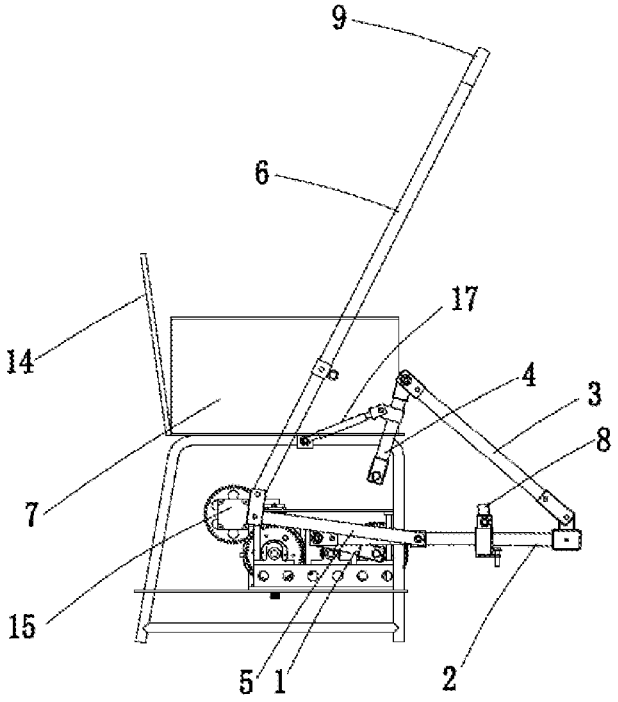
FIG. 3 is the front view of the second scheme of the Invention, which adopts a linear actuator to replace an accessory shaft and accessory driving chain.

In combination with FIGS. 3 and 5, as the second Embodiment of the Invention, the foldable and track-changeable training chair for coordinated exercises of upper and lower limbs comprises: a seat 14, a driving device 15 arranged below the seat and the racks 7 arranged on both sides of the seat; an out-stretched driving shaft 12 is arranged on each side of the driving device; two seven-bar mechanisms 16 are symmetrically distributed on both sides of the seat;

the seven-bar mechanism comprises: a crank 1, a first connecting rod 2, a second connecting rod 3, a side link 4, a third connecting rod 5, a jointed arm 6 and a rack 7; one end of the crank 1 is fixed to the driving shaft 12 and the other end is hinged to the head end of the said first connecting rod 2 to form a revolute pair; the tail end of the first connecting rod 2 is hinged to the head end of the said second connecting rod 3 to form a revolute pair; the tail end of the second connecting rod 3 is hinged to the head end of the side link 4 to form a revolute pair; the tail end of the side link 4 is hinged to the said rack 7; one end of the third connecting rod 5 is hinged to the intermediate section of the first connecting rod 2 to form a revolute pair; the other end of the third connecting rod is hinged to the bottom of the jointed arm 6 to form a revolute pair; the intermediate section of the jointed arm 6 is hinged to the rack 7 to form a revolute pair; setting a linear actuator 17, one end of the said linear actuator is hinged to the rack 7 to form a revolute pair and the other end is hinged to the intermediate section of the side link 4 to form a revolute pair;

a foot support 8 is installed on the first connecting rod 2 or the second connecting rod 3 and a handle 9 is installed on the upper end of the jointed arm 6.

One end of the linear actuator is hinged to the rack to form a revolute pair and the other end is hinged to the intermediate section of the side link 4 to form a revolute pair. The linear actuator also possesses self-locking function and the angle of side link 4 may be adjusted through extension and retraction. In the specific embodiment, as for the linear actuator 17, the linear actuator of LAM, LAS and LAN, etc. produced by Hiwin Mikrosystem Corp. may be adopted.

According to the physical parameters and training requirement of the training object during application, the foot support 8 may be adjusted to a proper position on the first connecting rod 2 or the second connecting rod 3, or the side link 4 may be adjusted to a proper position through the linear actuator 17, and the initial position of the jointed arm 6 may be adjusted to a proper position; then the side link 4 will stay still when the brake or the self-locking mechanism works. The two hands of the upper limbs of the trainee contact with the right and left handles 9 respectively and the two feet of the lower limbs contact with the right and left foot supports 8 respectively; the crank 1 is driven to rotate for a complete cycle by the driving shaft 12 through the main driving chain 11, then the handles and foot supports are driven to move by the crank according to the expected track and speed to achieve the training objectives; if the exercise track of the supported handles (pedals) is not within a proper range of exercises of the user, then the side link 4 may be rotated to a certain angle to realize the position adjustment within the corresponding range to make the exercise track of the handles and foot supports within the proper range of exercises of the user, thus the different training demands of different users may be satisfied. In order to realize more complicated forms of exercise, the side link 4 and the crank 1 may be rotated at the same time.

If a resistance device, e.g., a torque adjustable friction brake is installed in or outside the driving shaft 12 and the main driving chain 11, the resistance torque may be controlled to provide resistance to active exercises and thus to realize the purpose of strength training in active exercises of which the tracks are specified; in combination with motor, the needs of active and passive exercises may be both satisfied.

If a brake is installed in the driving shaft 12 or the main driving chain 11, the initial phases on both sides may be adjusted and remained unchanged so as to realize synchronous/asynchronous training.

The crank 1 may be either rod-shaped or disc-shaped. The crank 1 may be either arranged at the bottom of the mechanism (as shown in FIGS. 1, 2, 3, and 4) or on the top of the mechanism (as shown in FIG. 5).

What is claimed is:

1. A foldable and track-changeable training chair for coordinated exercises of upper and lower limbs, comprising:

a seat (14), a driving device (15) arranged below the seat, racks (7) arranged on first and second sides of the seat; wherein an out-stretched driving shaft (12) and an accessory shaft (10) are arranged on first and second sides of the driving device; two seven-bar mechanisms (16) are distributed symmetrically on the first and second sides of the seat;

the seven-bar mechanism comprises: a crank (1), a first connecting rod (2), a second connecting rod (3), a side link (4), a third connecting rod (5), a jointed arm (6) and a rack (7); a first end of the crank (1) is fixed to the driving shaft (12) and a second end of the crank (1) is attached by a first hinge joint to a head end of the first connecting rod (2) to form a revolute pair; a tail end of the first connecting rod (2) is attached by a second hinge joint to a head end of the second connecting rod (3) to form a revolute pair; a tail end of the second connecting rod (3) is attached by a third hinge joint to a head end of the side link (4) to form a revolute pair; a tail end of the side link (4) is fixed to the accessory shaft (10); a first end of the third connecting rod (5) is attached by a fourth hinge joint to the crank (1) or the first connecting rod (2) or the second connecting rod (3) to form a revolute pair; a second end of the third connecting rod (5) is attached by a fifth hinge joint to a bottom of the jointed arm (6) to form a revolute pair; an intermediate section of the jointed arm (6) is attached by a sixth hinge joint to the rack (7) to form a revolute pair;

a foot support (8) is installed on the first connecting rod (2) or the second connecting rod (3) and a handle (9) is installed on the upper end of the jointed arm (6).

2. The foldable and track-changeable training chair for coordinated exercises of upper and lower limbs according to claim 1, wherein the driving shaft (12) is driven to rotate by a power mechanism through a main driving chain (11); the accessory shaft (10) is driven to rotate by an accessory driving chain (13).

3. The foldable and track-changeable training chair for coordinated exercises of upper and lower limbs according to claim 1, wherein the fourth hinge joint is adjustable; the sixth hinge joint is adjustable; the position of the foot support (8) on the first connecting rod (2) or the second connecting rod (3) is adjustable.

4. A foldable and track-changeable training chair for coordinated exercises of upper and lower limbs, comprising:

a seat (14), a driving device (15) arranged below the seat, racks (7) arranged on first and second sides of the seat; wherein an out-stretched driving shaft (12) is arranged on first and second sides of the driving device; two seven-bar mechanisms (16) are distributed symmetrically on the first and second sides of the seat;

the seven-bar mechanism comprises: a crank (1), a first connecting rod (2), a second connecting rod (3), a side link (4), a third connecting rod (5), a jointed arm (6) and a rack (7); a first end of the crank (1) is fixed to the driving shaft (12) and a second end of the crank (1) is hinged to a head end of the first connecting rod (2) to form a revolute pair; a tail end of the first connecting rod (2) is hinged to a head end of the second connecting rod (3) to form a revolute pair; a tail end of the second connecting rod (3) is hinged to a head end of the side link (4) to form a revolute pair; a tail end of the side link (4) is hinged to the rack (7); a first end of the third connecting rod (5) is hinged to the first connecting rod (2) or the crank (1) to form a revolute pair; a second end of the third connecting rod (5) is hinged to a bottom of the jointed arm (6) to form a revolute pair; an intermediate section of the jointed arm (6) is hinged to the rack (7) to form a revolute pair; a linear actuator (17) is arranged; a first end of the linear actuator (17) is hinged to the rack (7) to form a revolute pair and a second end of the linear actuator (17) is hinged to an intermediate section of the side link (4) to form a revolute pair;

a foot support (8) is installed on the first connecting rod (2) or the second connecting rod (3) and a handle (9) is installed on the upper end of the jointed arm (6).

* * * * *